US005693294A

United States Patent [19]

Anderson et al.

[11] Patent Number: 5,693,294

[45] Date of Patent: Dec. 2, 1997

[54] EXHAUST GAS FLUIDICS APPARATUS

[75] Inventors: James G. Anderson, Beaver Dams; Thomas A. Collins, Horseheads, both of N.Y.; G. Daniel Lipp, Fort Collins, Colo.; Kathleen E. Morse; Louis S. Socha, Jr., both of Painted Post, N.Y.

[73] Assignee: Corning Incorporated, Corning, N.Y.

[21] Appl. No.: 685,130

[22] Filed: Jul. 24, 1996

Related U.S. Application Data

[63] Continuation-in-part of Ser. No. 578,774, Dec. 26, 1995, abandoned.

[51] Int. Cl.[6] ..... B01D 50/00

[52] U.S. Cl. ..... 422/171; 422/177; 422/180; 422/181; 60/288; 60/303; 55/309

[58] Field of Search ..... 422/171, 176, 422/177, 180, 181; 60/299, 300, 274, 288, 311, 303; 55/DIG. 30, 309

[56] References Cited

U.S. PATENT DOCUMENTS

| | | | |
|---|---|---|---|
| 3,144,309 | 8/1964 | Sparrow . | |
| 3,749,130 | 7/1973 | Howitt et al. . | |
| 3,783,619 | 1/1974 | Alquist . | |
| 3,988,890 | 11/1976 | Abthoff et al. . | |
| 3,995,423 | 12/1976 | Aoki et al. . | |
| 4,023,360 | 5/1977 | Wössner et al. . | |
| 4,947,768 | 8/1990 | Carboni | 110/214 |
| 5,062,263 | 11/1991 | Carboni | 60/299 |
| 5,067,319 | 11/1991 | Moser . | |
| 5,110,560 | 5/1992 | Presz, Jr. et al. | 422/176 |
| 5,315,824 | 5/1994 | Takeshima . | |
| 5,449,499 | 9/1995 | Bauer et al. . | |
| 5,538,697 | 7/1996 | Abe et al. . | |

FOREIGN PATENT DOCUMENTS

| | | |
|---|---|---|
| 0 661 098 | of 1995 | European Pat. Off. . |
| 0 697 505 | of 1996 | European Pat. Off. . |
| 3919343 | of 1990 | Germany . |
| 1 275 772 | 5/1972 | United Kingdom . |
| 2 240 486 | 8/1991 | United Kingdom . |
| 95/18292 | 7/1995 | WIPO . |

OTHER PUBLICATIONS

S.N. 08/484,617; Filed Jun. 8, 1995; In–Line Adsorber System.

S.N. 08/375,699; Filed Jan. 19, 1995; By–Pass Adsorber System.

*Primary Examiner*—Christopher Kim

*Attorney, Agent, or Firm*—Timothy M. Schaeberle

[57] ABSTRACT

The invention is directed at an engine exhaust system comprising: (1) a honeycomb structure having an inlet and outlet end disposed in a housing located in an exhaust gas stream downstream from an engine, and having a first substantially unobstructed flow region, and a second more obstructed flow region adjacent the first region, both providing a flow path for the exhaust gases in the exhaust gas stream; and, (2) a fluidics apparatus disposed in the exhaust stream comprising a bi-convex diverter body with the respective surfaces located upstream and downstream of each other, located upstream and proximate to the first region, a diversion fluid source and a conduit possessing a rounded outlet for directing the diversion fluid toward the diverter body.

22 Claims, 11 Drawing Sheets

EXHAUST GAS FLUIDICS APPARATUS

This application is a continuation-in-part of U.S. patent application Ser. No. 08/578,774, filed Dec. 26, 1995, now abandoned

FIELD OF THE INVENTION

This invention relates to an improved engine exhaust system, and more particularly to an exhaust system comprised of a honeycomb structure having a first substantially unobstructed flow region and a second more obstructed flow region adjacent the first region, and an improved fluidics apparatus having a streamlined diverter body.

BACKGROUND OF THE INVENTION

Catalytic converters are well known for reducing oxides of nitrogen (NOx), and oxidizing hydrocarbons and carbon monoxide from automobile exhaust. These catalytic reactions typically take place after the catalyst has attained its light-off temperature, at which point the catalyst begins to convert the hydrocarbons to harmless gases. The typical catalytic light-off time for most internal combustion engine systems is around 50 to 120 seconds (generally in the temperature range of 200°–350° C.), with the actual catalytic light-off time for any system depending on a number of factors; including, the position of the catalyst relative to the engine, the aging of the catalyst, washcoat technology, as well as the noble metal loading. Seventy to almost ninety five percent of hydrocarbon emissions from automotive vehicles are emitted during this first minute, or so, of "cold start" engine operation. Without additional measures large amounts of hydrocarbons are likely to be discharged into the atmosphere during this period. The problem is made worse by the fact that the engines require rich fuel-air ratios to operate during cold-start thus, increasing even further the amount of unburned hydrocarbons discharged.

It has become increasingly important to improve the effectiveness of automotive emission control systems during cold start, so as to keep the amount of hydrocarbons discharged into the atmosphere during cold-start, at extremely low levels. Various schemes have been proposed, including, the use of electrically heated catalysts (EHCs) to reduce the light-off time of the main catalyst, the use of molecular sieve structures (hydrocarbon adsorbers) to adsorb and hold significant amounts of hydrocarbons until the converter has attained its light-off temperature, as well as combinations of both.

Recently, improved in-line and by-pass exhaust control systems respectively have been disclosed in U.S. Pat. No. 5,603,216 (Guile et al.) and Ser. No. 08/484,617 (Hertl et al.); both co-assigned to the instant assignee, and herein incorporated by reference. The Guile reference discloses a by-pass adsorber system wherein flow patterns from a secondary air source are used to direct exhaust gas flow to and away from the adsorber during cold-start.

The Hertl reference discloses an in-line exhaust system having a main catalyst, a housing downstream of the main catalyst having disposed therein a molecular sieve structure for adsorbing hydrocarbons, as well as a burn-off catalyst disposed downstream from the adsorber having a light-off temperature. The molecular sieve structure exhibits: (1) a first region forming an unobstructed or substantially unobstructed flow path for exhaust gases of an exhaust stream; and, (2) a second, more restricted flow path or region adjacent the first region. An additional feature of the system is a diverter disposed in the housing for passing secondary air into the housing; the flow pattern of the secondary air directs a portion of the exhaust gases through the second region of the adsorber prior to the main catalyst attaining its light-off temperature.

Although, these systems performed better than earlier exhaust systems, environmental concerns and legislation drafted to meet those concerns continues to lower legally acceptable hydrocarbon emission standards, e.g., the California ultra-low emission vehicle (ULEV) standards. Notwithstanding the foregoing developments, work has continued to discover improvements to existing systems and to provide new systems capable of meeting the stricter exhaust emission standards.

One such improvement is disclosed in copending, coassigned application, U.S. Ser. No. 08/578,003 (Brown et al.) wherein it discloses an exhaust system comprised of the following: (1) a honeycomb structure having an inlet and outlet end disposed in a housing and possessing a first substantially unobstructed flow region, a second more obstructed flow region adjacent the first region; and, (2) a fluidics apparatus disposed in the exhaust stream proximate to the first region for creating a negative flow zone within the first region. The fluidics apparatus of Brown includes a source of a diversion fluid, typically air, and a diverter body for diverting the diversion fluid, both of which combine to result in the negative flow zone and to divert the exhaust gas away from the first flow region toward the second flow region.

Although this system provides improved performance for substrates possessing two flow paths/regions, the resulting flow characteristics for this system under non-diverting conditions, are not ideal: the exhaust flow through higher flow resistance or second flow path is considerably higher than desired.

SUMMARY OF THE INVENTION

Accordingly, described herein is an engine exhaust system exhibiting increased flow performance, i.e., enhanced flow efficiency. The system is comprised of the following: (1) a honeycomb structure having an inlet and outlet end disposed in a housing located in an exhaust gas stream downstream from an engine, and having a first substantially unobstructed flow region, and a second more obstructed flow region adjacent the first region, both providing a flow path for the exhaust gases in the exhaust gas stream; and, (2) a fluidics apparatus disposed in the exhaust stream comprising a bi-convex diverter body with its respective surfaces located upstream and downstream of each other and located proximate to the first region, a diversion fluid source and a tapered conduit possessing a rounded outlet for directing the diversion fluid toward the diverter body.

Described herein is another embodiment of the exhaust apparatus wherein the fluidics apparatus optionally possesses an exhaust flow convergent device, preferably exhibiting a funnel or cone shape. This convergent device has particularly utility as a component of the fluidics apparatus when the area of the exhaust gas flow upstream of the diverter body is considerably larger than the frontal area of the first flow region.

An additional engine exhaust system embodiment comprising a honeycomb structure and a fluidics apparatus is also described. The fluidics apparatus, disposed in the exhaust stream, is comprised of the following: (1) an exhaust gas converger means for directing the flow of the exhaust towards the first flow region; (2) a diverter body located downstream of the exhaust gas converger means proximate to the first region; (3) a diversion fluid source; and, (4) a tapered conduit possessing a rounded outlet for directing the diversion fluid toward the diverter body.

DETAILED DESCRIPTION OF THE INVENTION

Resultant exhaust gas flow patterns when a diverter system is operational are described in the copending Brown and Hertl applications. As described therein, the exhaust gases are directed towards the honeycomb structure whereupon a fluidics apparatus located proximate to the inlet of the low resistance flow region, diverts the exhaust gases. The operation of the fluidics apparatus specifically involves directing a diversion fluid toward and into contact with a diverter body, thereby causing the diversion fluid to exhibit a flow component transverse to the flow direction in the central or first flow region; i.e., radially diverting the diversion fluid. In other words, this diversion fluid is diverted into the path of the exhaust gas to direct at least a portion of the exhaust gas into the second flow or peripheral region.

Figure 1:
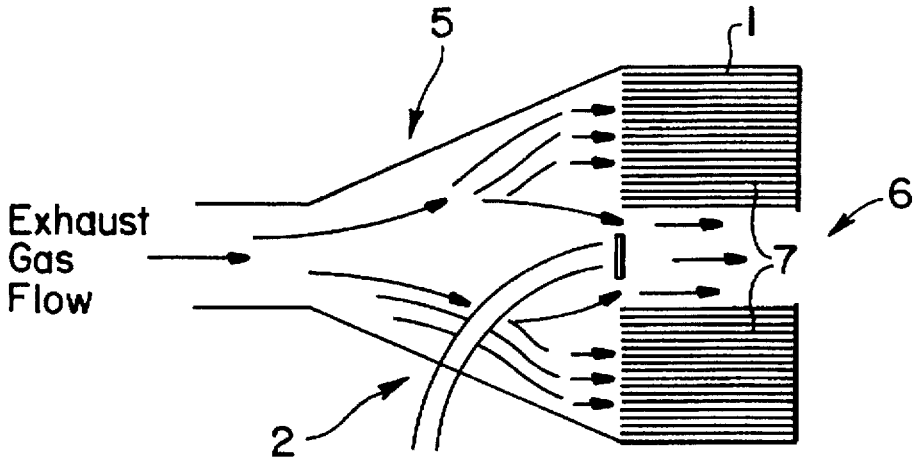
FIG. 1 is a schematic illustrating, generally, the direction of undiverted exhaust gas flow through a honeycomb structure.
Figure 2:
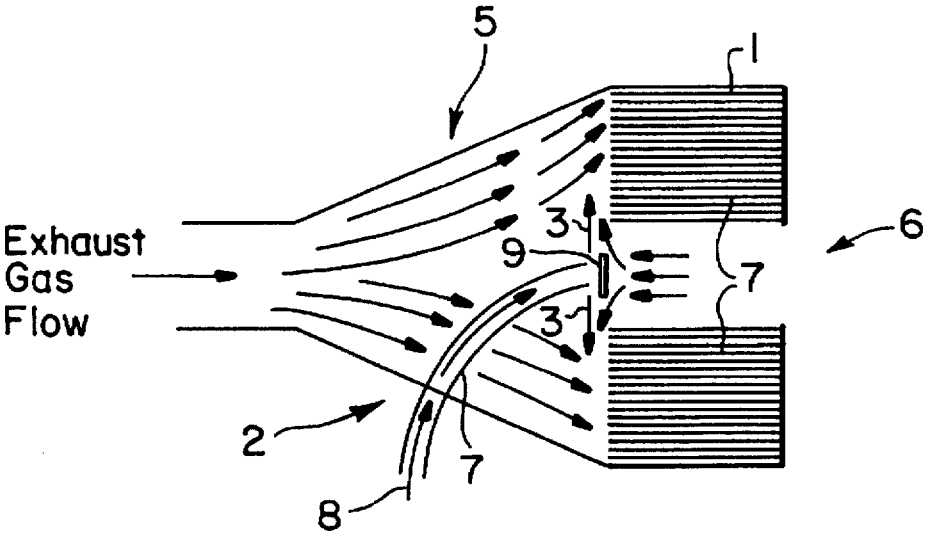
FIG. 2 is a schematic illustrating the direction of exhaust gas flow through a honeycomb structure created during "diverted" operation.

Referring to FIGS. 1 and 2 depicted therein are the flow patterns of exhaust gas under undiverted conditions (diverter-off) and the flow pattern of exhaust gases and diversion fluid under diverted conditions (diverter-on); the flow arrows indicating the flow patterns. FIG. 1 schematically illustrates the diverter-off flow pattern typical of exhaust gas. e.g., during normal, hot engine operation, for a system containing an adsorber and a non-operating fluidics apparatus. In general, the majority of undiverted exhaust gas which enters the housing 5 flows through the central hole 6, bypassing the peripheral surfaces 7 of the honeycomb substrate 1. In other words, as a result of standard fluid dynamics, the exhaust gases tend to exhibit a higher volume flow through the low-flow resistance region 6, centrally positioned in this embodiment, of the honeycomb structure than through the peripheral regions 7.

FIG. 2 illustrates the flow pattern of the exhaust gas which results when the diverter system is operational, .e.g., during cold start, where a fluidics apparatus in the exhaust stream diverts the gas flow radially outward to flow through the adsorber honeycomb rather than through the central hole. In general, the exhaust gases flowing from an engine enter a housing 5 and continue towards the honeycomb structure 1 whereupon the fluidics apparatus 2, located proximate to the inlet of a low flow resistance or central hole region 6, functions to divert the exhaust gases. The operation of the fluidics apparatus 2 specifically involves introducing into the housing 5 and directing towards and into contact with a diverter body 9, a diversion fluid 8 via a diversion fluid conduit 7, thereby radially diverting the fluid into the path of the exhaust gas. In other words, flow component is imparted to the diversion fluid which is transverse to the direction of exhaust gas flow entering the housing. This diversion, or change in flow pattern, of the diversion air essentially results in the formation of a fluid shield (arrow pair 3) in front of the central flow region 6 which redirects a portion of the exhaust gases away from the first or central flow region 6 and toward a second or peripheral flow region 7.

It is appreciated that this typical flow, diverted and undiverted, occurs for any system which possesses a some type of fluidics diverter and a substrate which possesses two separate flow regions and not just those in-line systems where the substrate is an adsorber. Ideally, in any of the exhaust systems comprising the fluidics apparatus, it is desirable during diverted operation to achieve either a negative flow, as disclosed in Brown et al., or low positive flow of less than 20% of total exhaust through the low flow resistance region. Furthermore, when the diversion air is off the diverter body should permit maximum flow i.e., ~100% through the center hole with little or no exhaust diverted through the honeycomb body.

Figure 3:
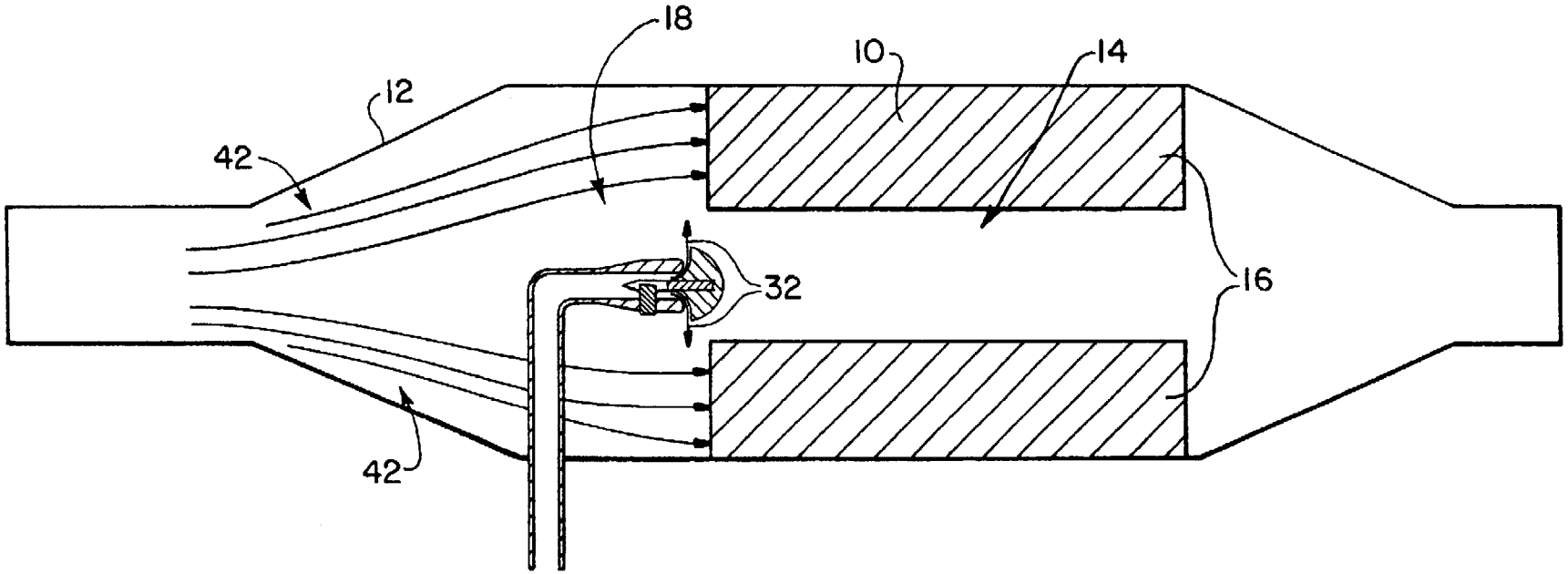
FIG. 3 is a elevational cross-sectional view of the invention showing an exhaust system in which exhaust gas flows from the engine to the honeycomb structure.

Referring now to FIG. 3 depicted therein is an engine exhaust system which overcomes the aforementioned shortcomings of previous fluidics divetier-containing exhaust systems; i.e., that of an inefficient diverter-off flow. In other words, this inventive exhaust system provides increased flow performance, i.e., a fluidics apparatus which provides an increased flow efficiency during diverter-off conditions. Specifically, FIG. 3 depicts an engine exhaust system comprising honeycomb structure 10 having an inlet and outlet end disposed in housing 12 and located in an exhaust gas stream downstream from an engine (not shown). Honeycomb structure 10 possesses first substantially unobstructed flow region 14, and second more obstructed flow region 16 adjacent first region, the first region being disposed to provide a substantially unobstructed flow path for the exhaust gases in the exhaust gas stream. The system further includes fluidics apparatus 18 disposed in the exhaust stream and comprised of the following elements, as detailed in FIG. 4: (1) diverter body 20 having biconvex surfaces, one positioned upstream 22 and one downstream 24; (2) diversion fluid source, typically an air pump (not shown) capable of delivering diversion air at the required flow rates; and, (3) tapered conduit 26 possessing rounded outlet 28 for directing diversion fluid toward the diverter body 20. Additionally, the diverter body 20 is located proximate first or low flow resistance region 14.

Figure 4:
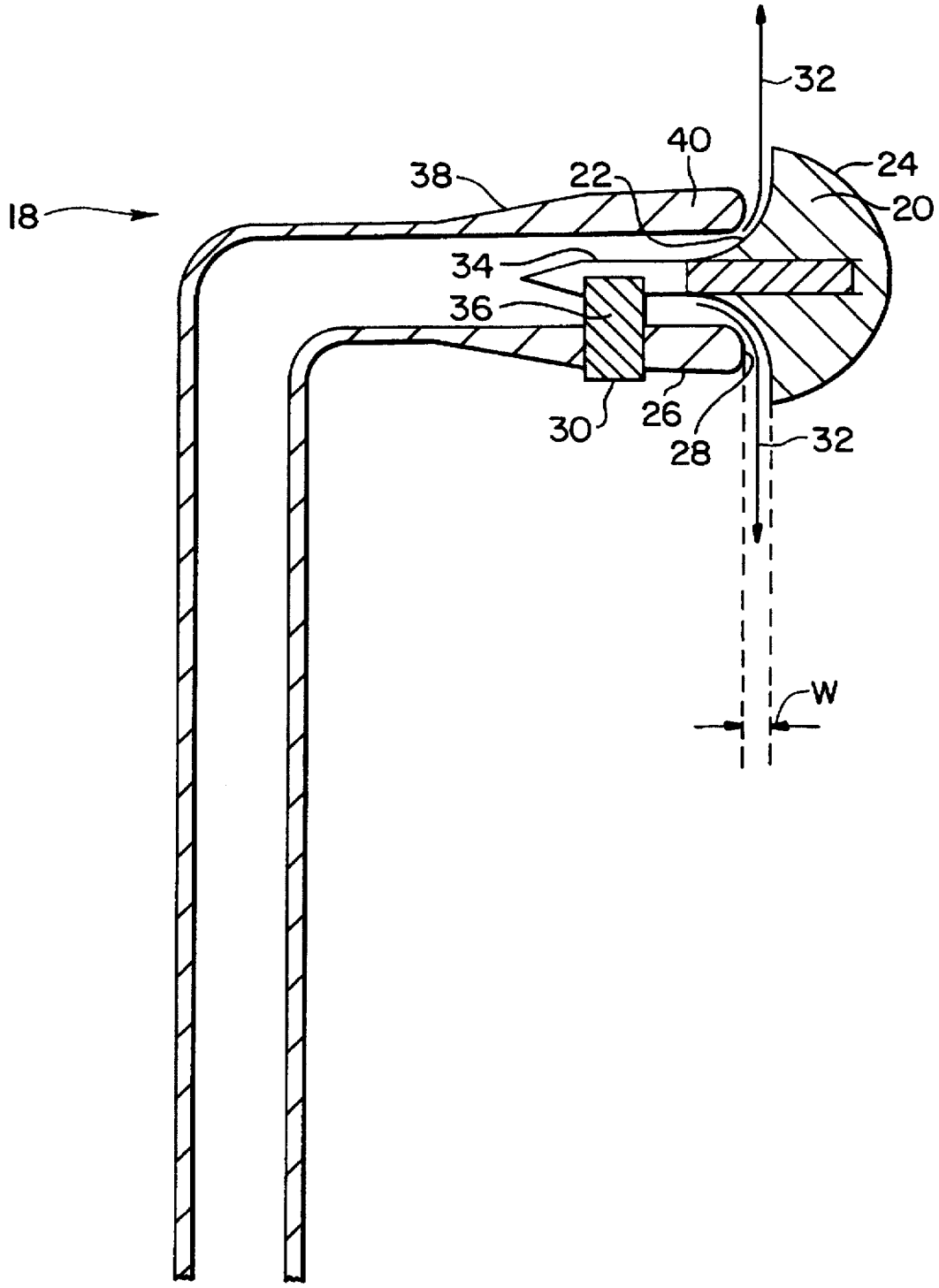
FIG. 4 an enlarged side view of a bi-convex flow diverter body and tapered conduit as depicted in FIG. 3.

Referring to FIG. 4, diverter body 20 is explained in greater detail. The diverter body is dissected by a reference plane which is perpendicular to, and defined by the x and y axis shown therein. Furthermore, this plane is transverse to the direction of exhaust flow and separates the upstream and the downstream portion of the diverter. Referring specifically now to upstream surface 22 and downstream 24 surface, they are both convex in their respective upstream and downstream directions when defined by the aforementioned reference plane.

Figure 5:
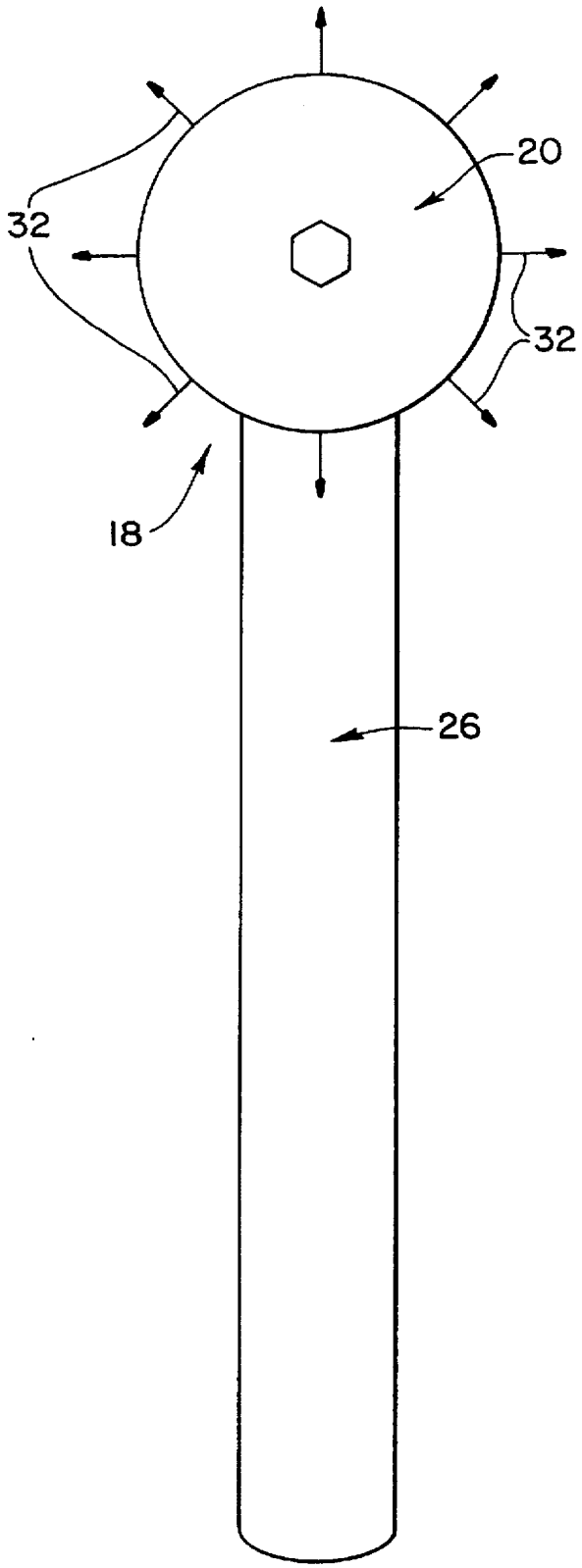
FIG. 5 is a front view of the flow diverter body of FIG. 4.

Referring now to FIGS. 4 together with FIG. 5, depicted therein an enlarged view fluidics apparatus 18; the apparatus includes diverter body 20, with the bi-convex diverter body's downstream surface 24 exhibiting a curved outward shape of varying radius ($R_1$) and the bi-convex diverter body's upstream surface 22 exhibiting a curved inward shape also of varying radius ($R_2$). Outwardly tapered conduit 26 possessing rounded outlet surface 28 for directing diversion fluid toward diverter body 20, is positioned variable slot distance W, upstream of diverter body 20 through the use of diverter support system 30. Conduit outlet surface 28 is positioned sufficiently close to diverter body 20 so to impart a flow component diversion fluid which is transverse to the direction of the exhaust flow entering the housing; this flow component indicated by arrow pair designated 32. Diverter support system 30 consists of: (1) support member 34 secured within the inside circumference of diversion fluid conduit 26; and, (2) threaded post 34. Diverter body 20 is directly attached to threaded post 34 allowing for the slot width to be varied.

It will be appreciated that other configurations of the diverter body besides that depicted herein are possible and include: (1) both downstream and upstream surfaces outwardly curved; (2) both downstream and upstream surfaces inwardly curved; (3) downstream surface inwardly curved and upstream surface outwardly curved; and (4) both upstream and downstream surfaces substantially flat.

Referring specifically to FIGS. 3 and 4, outwardly tapered fluid conduit tube conduit 26, which possesses upstream end 38 having an outer diameter which tapers outwardly to downstream end 40 having a larger outer diameter, functions to avoid abrupt obstructions to the exhaust gas flow. Additionally downstream end 40 possesses rounded outlet surface 28 possessing a varying radius ($R_3$). Streamlined diverter body's 20 upstream convex surface 22 is shaped whereby it functions to avoid abrupt obstructions to flow of the diversion fluid coming from tapered conduit. Furthermore, conduit 26 and upstream surface 22 essentially form a nozzle for optimum conversion of the diverter fluid pressure to velocity. Diverter body's upstream surface 22 continues to extend ending with the surface directed radially outward to aim the diverter fluid stream in the most efficient direction as depicted by diversion flow arrows designated 32. Finally, downstream surface 24 of diverter 20 is shaped so it operates to smooth the exhaust gas flow path into the hole in the honeycomb substrate with minimum turbulence. When the diversion fluid is flowing, as shown by diversion flow arrows 32, the exhaust gas takes the path generally indicated by flow arrows designated 42, i.e., away from low flow resistance or central hole region 14 and through higher flow resistance or peripheral region 14.

Figure 6:
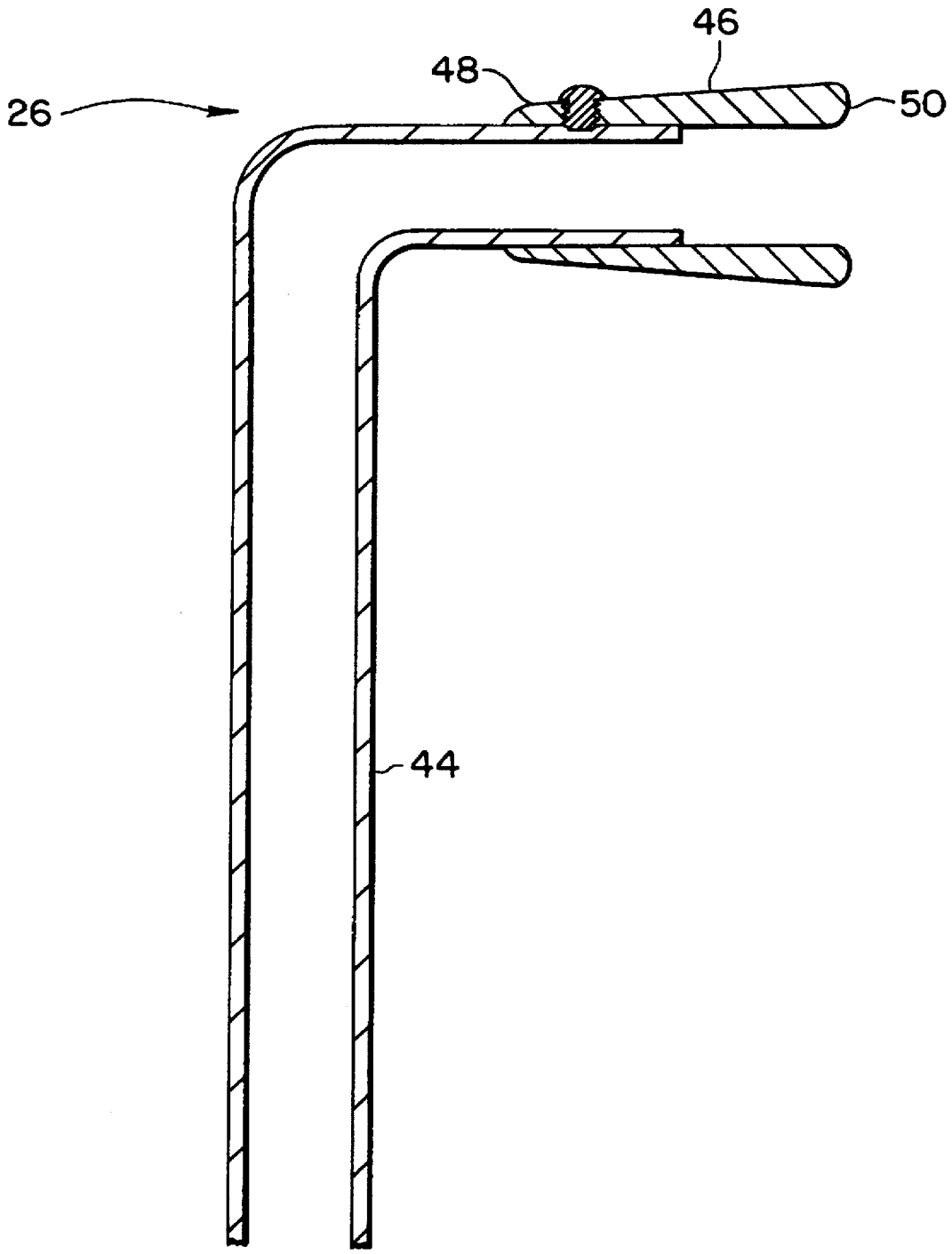
FIG. 6 is side view of an additional embodiment of a tapered conduit of the instant invention.

FIG. 6 illustrates another embodiment of tapered conduit 26. As illustrated therein, tapered conduit 26 can simply be comprised of a straight tube diversion fluid conduit 44 which has attached to its end tapered extension 46. Specifically, tapered extension 46, possesses upstream end 48 having an outer diameter which tapers outwardly to downstream end 50 having a larger outer diameter. Furthermore, both the left or upstream end 48 and right or downstream outlet end 50 exhibit a rounded contour exhibiting varying radii ($R_3$ and $R_4$, respectively,).

Figure 7:
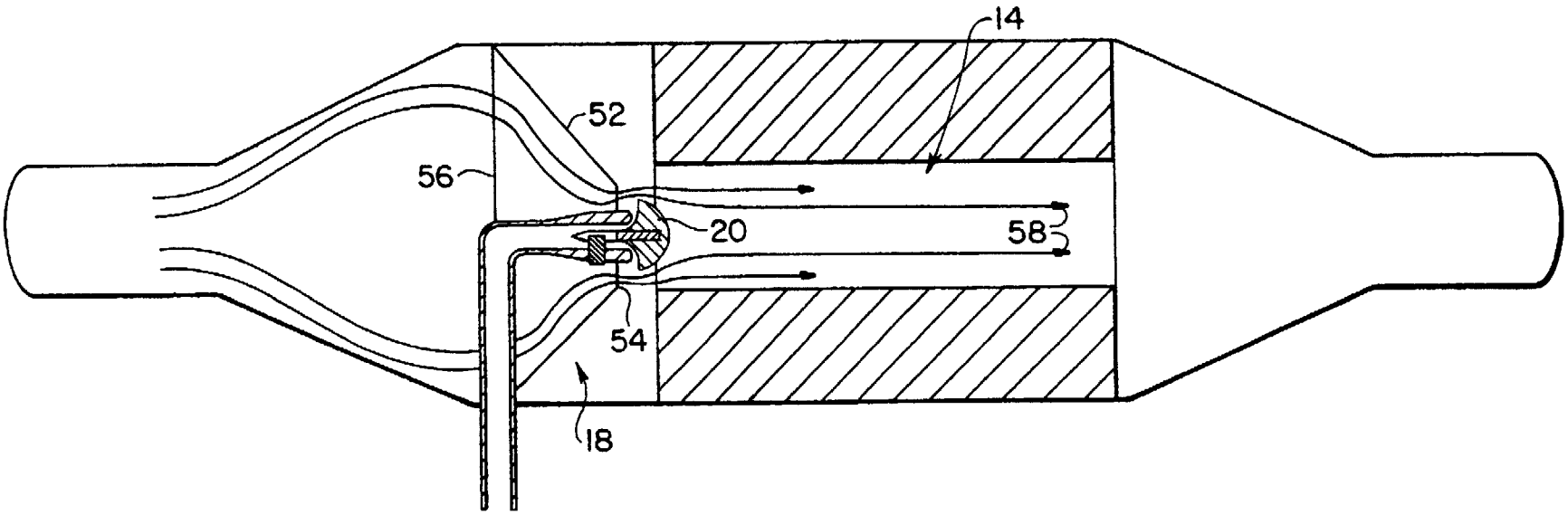
FIG. 7 is a elevational cross-sectional view of another embodiment of invention comprising an exhaust gas flow converger device.

Referring now FIG. 7 depicted therein is another embodiment of the instant exhaust apparatus. Fluidics apparatus 18 possesses an additional component, that of exhaust flow converger device 52, preferably exhibiting a funnel or cone shape. This component is contemplated to have particular utility as part of a fluidics apparatus where the area of the exhaust gas flow front upstream of diverter body 20 is considerably larger than the frontal area of low flow resistance region 14. This converger device serves to direct the incoming flow of exhaust gases toward low flow resistance region 14, a central hole in the depicted embodiment. As depicted therein, it is open at both ends, with smaller opening 54 positioned downstream and nearer the honeycomb structure and larger opening 56 positioned upstream. With no diversion fluid flowing, the exhaust gas follows a path shown by pair of flow arrows indicated as 58; i.e., a flow past diverter body 20 and through low flow resistance region 14.

Figure 7A:
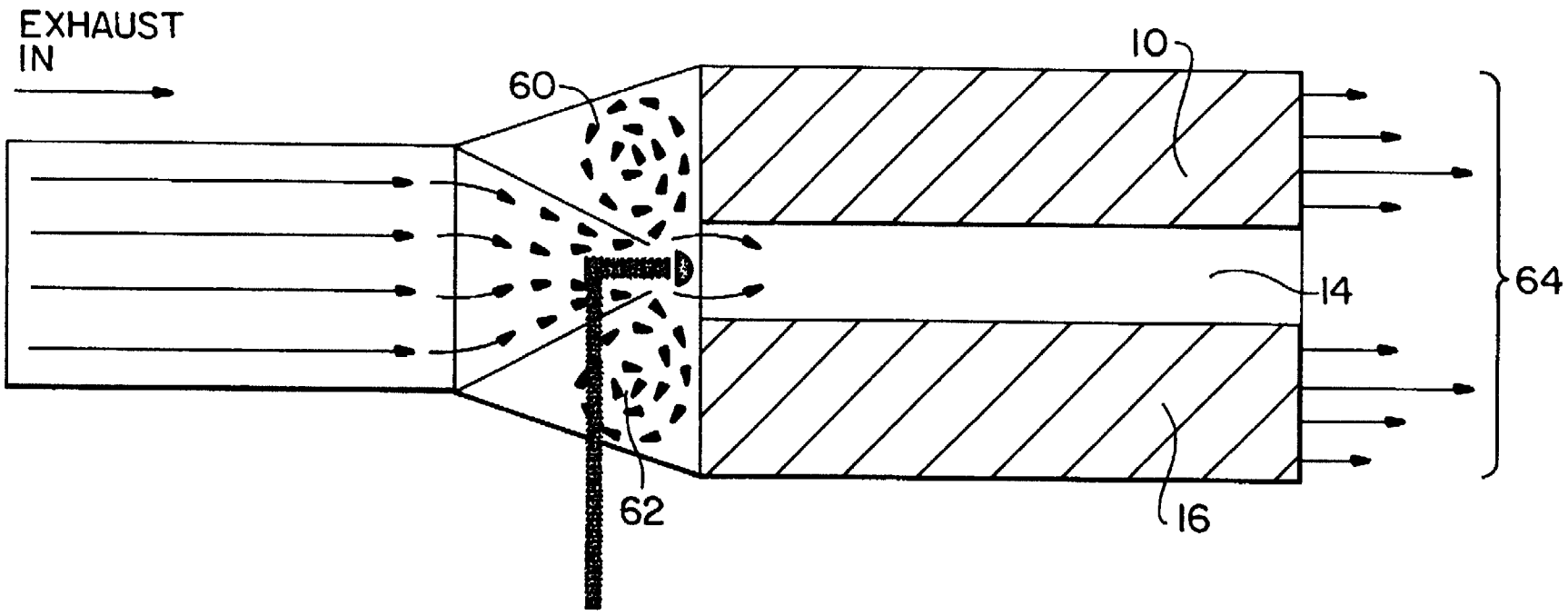
FIG. 7A is a schematic illustrating the direction of exhaust gas flow in a exhaust system having a converger device and a honeycomb structure.

Although the illustrated exhaust system provides the advantage of increased efficiency with which the gas flow may be directed to either of these two paths, i.e. an increased ability to divert completely to one flow path or the other, the uniformity of flow through the honeycomb structure is slightly sacrificed when the converger device component is utilized. While not intending to limited by theory it is thought that this slight reduction in uniformity is due, in part, to the sudden expansion of the concentrated exhaust gases as they emerge from the converger device into the inlet portion of the housing. This sudden expansion phenomenon, as illustrated in FIG. 7A, results in a pair of vortices or "eddy zones" 60, 62 which, in turn, result in blocking the flow of exhaust gases to the peripheral portions of honeycomb structure 10 thereby creating a reduction in the exhaust gas flow uniformity. In other words, the vortices cause a greater volume of the exhaust to flow through the portion of the honeycomb structure nearer central hole region 14 than in the peripheral portion 16. This exhaust-gas flow non-uniformity is illustrated by the flow arrows 64 exiting the honeycomb structure.

An embodiment in accordance with the invention which generates an improved exhaust gas flow uniformity is an exhaust system such as that described above, though modified slightly to include a honeycomb structure wherein the inlet face is of a generally convex configuration, i.e. a tapered honeycomb substrate inlet face. The purpose of this substrate modification is to produce a reduction in the blocking effect of the vortices thereby allowing for a more evenly distributed exhaust gas flow through the honeycomb.

Figure 8:
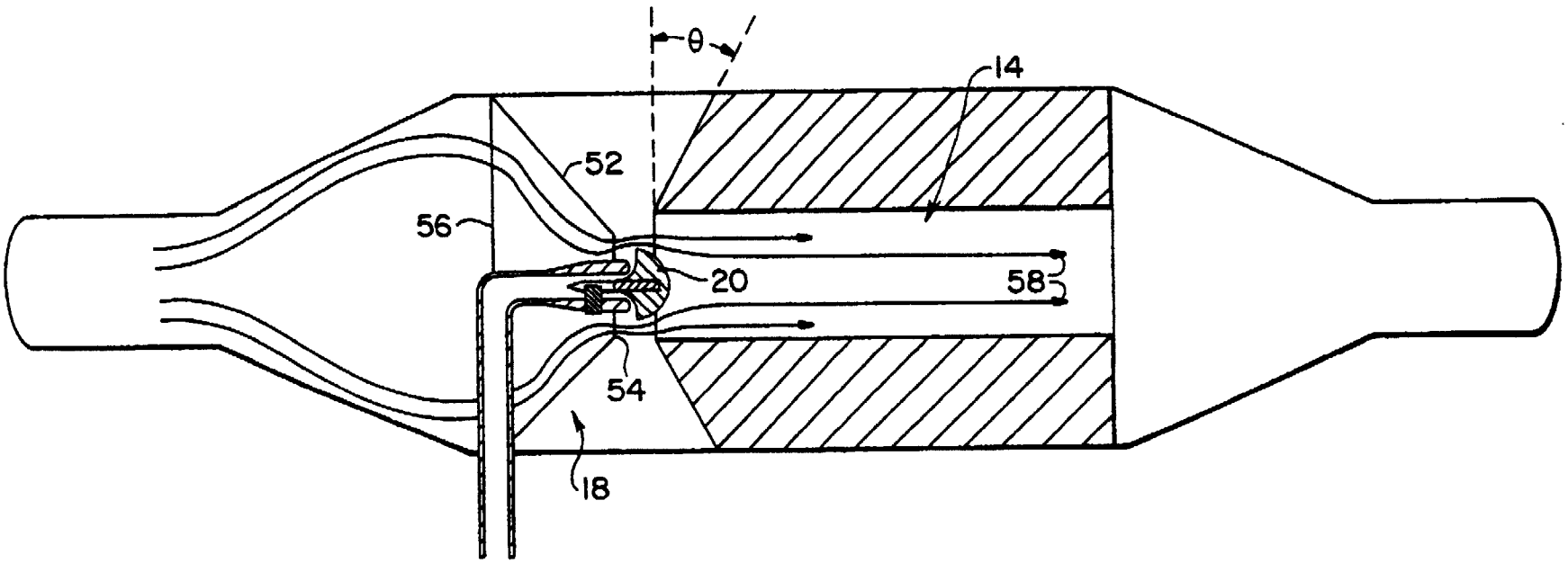
FIG. 8 is a elevational cross-sectional view of another embodiment of the invention comprising a tapered honeycomb substrate and an exhaust gas flow converger device.

An example of an engine exhaust system incorporating the design modification, i.e., the tapered honeycomb structure, is illustrated in FIG. 8. Illustrated therein is an exhaust system like that found in FIG. 7, the only modification being the improved, tapered substrate inlet shape which is capable of producing a uniform flow of exhaust gas through honeycomb structure inlet face. As the exhaust system of this embodiment is similar to that system in FIG. 7, the exception being the tapered honeycomb modification, like parts for FIG. 8 are identified with the same reference numerals used for the like parts of the exhaust system detailed in FIG. 7.

The precise shape of the inlet end face is determined on an empirical basis. Convex shapes which may be considered for use in the invention include conical, frustoconical, circular, parabolic, or elliptical shapes; furthermore, the shapes may be stepped or smoothly curved. The optimal shape for each system is a generally a function of the operating conditions and system geometry. Specifically, the optimal design of the inlet face is a function of the following parameters: exhaust flow rate, honeycomb radius, converger device geometry, housing geometry, diverter body-to-honeycomb distance and diversion fluid velocity.

The honeycomb structure utilized in this exhaust system may take on a variety of forms including: (1) a variable cell honeycomb structure having a first group of cells and a second group of cells whose cell sizes are smaller than the first group of cells; (2) a substantially cellular structure having an open region running longitudinally parallel between the inlet and outlet ends of the structure and a peripheral region adjacent the open region, the peripheral region having a plurality of cells running longitudinally parallel between the inlet and the outlet ends of the structure; (3) a honeycomb structure centrally disposed in the housing, having a frontal area, a first region comprising a central open core running longitudinally parallel between the inlet and outlet ends of the structure and a second region comprising a peripheral cellular structure characterized by a plurality of cells running longitudinally parallel between the inlet and the outlet ends of the structure; and, (4) a variable cell extruded honeycomb structure having a first central region and a second peripheral region surrounding, the cells in the first region being larger than the cells in the second region. It should be noted that in those embodiments exhibiting a central open core region that region should preferably occupy an area in the range of 0.5 to 50% of the frontal area of the honeycomb structure;

Optional components which may be provided in inventive exhaust system include sensors for determining the concentrations of hydrocarbons present in the exhaust, as well as secondary air inlets such as for controlling the stoichiometry of the gases being treated (neither component is shown in the FIGS.).

Figure 9:
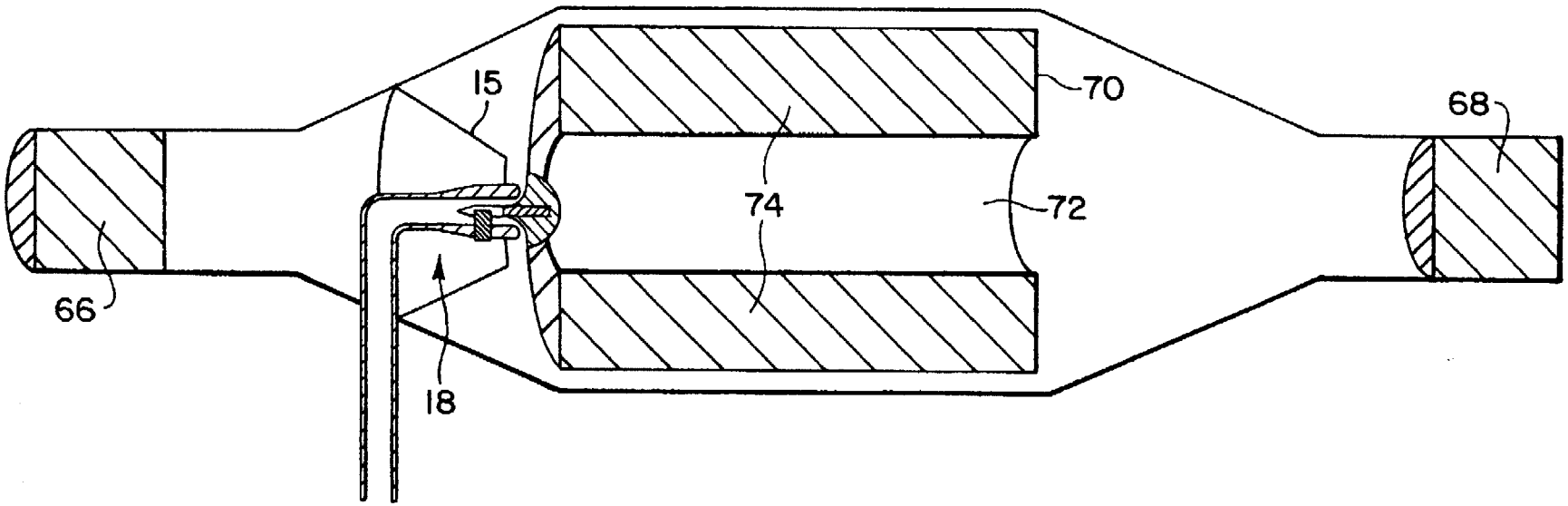
FIG. 9 is a elevational cross-sectional view of one embodiment of the invention incorporated into an overall "in-line" exhaust system.

As disclosed in the aforementioned cop ending references, it is contemplated that this fluidics apparatus described above and illustrated in the examples below, has particular utility as a component in an overall "in-line" exhaust system akin to that described Hertl et al. reference, i.e., the honeycomb substrate described above comprises a molecular sieve or hydrocarbon adsorber. Referring now to FIG. 9, this "in-line" exhaust system generally includes the following: (1) main catalytic converter 66 having a light-off temperature disposed downstream from an engine; (2) burn-off catalyst 68 disposed in the exhaust stream downstream from main catalytic converter 66; and (3) the exhaust system described above wherein honeycomb structure 70 comprises a molecular sieve or hydrocarbon adsorber. More specifically, honeycomb structure 70, possesses an inlet and outlet end, is located in the exhaust stream between main catalytic converter 66 and bum-off catalyst 68, and exhibits a desorption temperature. Molecular sieve 70 includes first substantially unobstructed flow region 72, and second more obstructed flow region 74 adjacent first region, the first region being disposed in the exhaust stream to provide a substantially unobstructed flow path for exhaust gases in the exhaust stream from the engine to the bum-off catalyst. This exhaust system further comprises fiuidics diverter 18, as described above, positioned proximate to center or first flow region 72 and a source and conduit for diversion fluid for diverting the exhaust gases away from first region 72 into second region 74 to adsorb hydrocarbons while second region 74 is below the molecular sieve's desorption temperature. Furthermore, the "in-line" system includes exhaust flow converger device 15 as described above.

Figure 10:
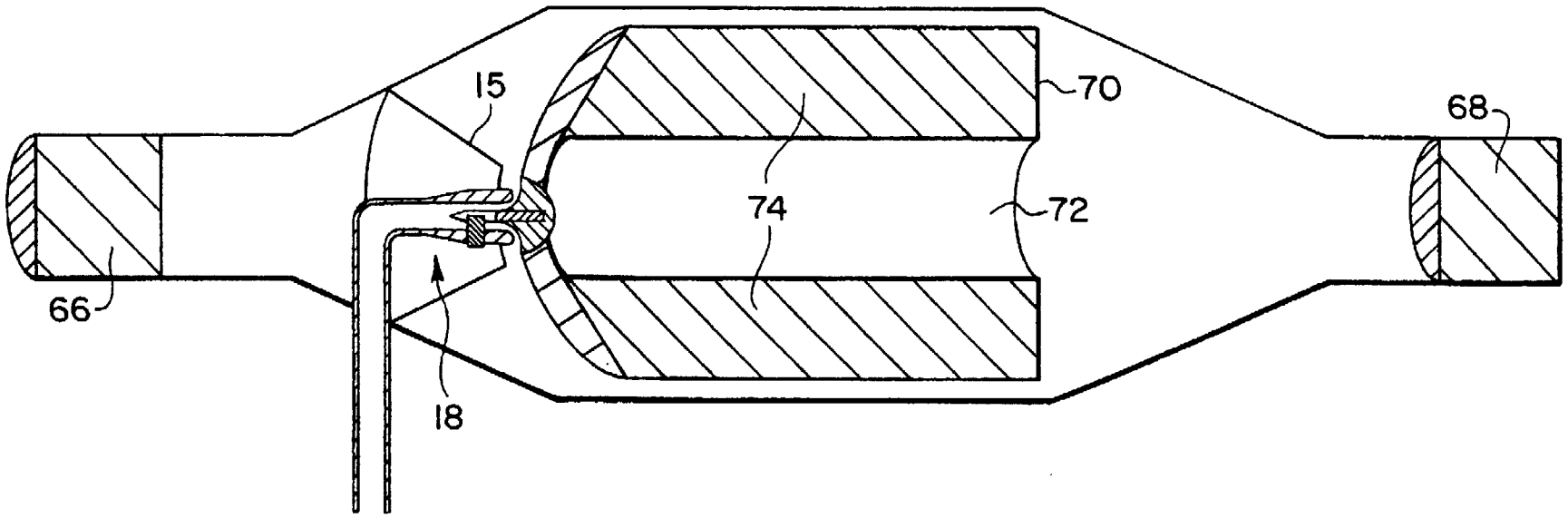
FIG. 10 is elevational cross-sectional view of another embodiment of the inventive exhaust system incorporated into an overall "in-line" exhaust system.

Referring now to FIG. 10 illustrated therein is another embodiment of the aforementioned "in-line" system, the only modification being the tapered modification of the honeycomb/adsorber structure so as to increase the flow uniformity of the exhaust gases; i.e., the inclusion of adsorber structure having a convexly shaped inlet end. As this "in-line" exhaust system is similar to that system in FIG. 9, except for the tapered honeycomb modification, it follows that like parts for FIG. 10 are identified with the same reference numerals used for the same parts of exhaust system detailed in FIG. 9.

The advantages of utilizing the tapered honeycomb in the exhaust flow converger device-containing "in-line" system are as follows: (1) an improved flow uniformity through the adsorber structure which, in turn, minimizes the length of the adsorber necessary to effectively adsorb the hydrocarbons and improves the performance of both the adsorber and therefore, the overall exhaust system; (2) a reduction of the exhaust gas peak velocity, as well as the movement of the that peak velocity to a more peripheral position thereby reducing the desorption rate of the adsorber.

A further advantage of utilizing the tapered adsorber is the ability to radially position the adsorber inlet face farther away from the fluidics diverter body thereby reducing the blocking effect of the vortices on the exhaust gases. This, in turn results in reducing the momentum required for diversion. This being the case, achieving equivalent diversion angle requires less diversion fluid velocity, thereby allowing the fluidics apparatus to be operated with a larger gap between the diverter body and the diversion fluid conduit. This larger diverter gap sufficiently reduces the back pressure, which develops between the diversion fluid-delivering pump and the diverter body, thereby enabling the desired diversion fluid flow rate to be obtained using commercially available pumps.

A "molecular sieve" as used herein refers to crystalline substances or structures having pore sizes suitable for adsorbing molecules. The term is generally used to describe a class of materials that exhibit selective absorption properties. To be a molecular sieve, as disclosed herein the material must separate components of a mixture on the basis of molecular size and shape differences. Such materials include silicates, the metallosilicates, metalloaluminates, the $AlPO_4$s, silico- and metalloaluminophosphates, zeolites and others described in R. Szostak, *Molecular Sieves: Principles of Synthesis and Identification*, pages 2–6 (Van Nostrand Reinhold Catalysis Series, 1989). Furthermore, the terms "adsorber" and "adsorption" as used herein are intended to encompass both adsorption and absorption as these terms are generally known to persons skilled in the art and as defined in *Webster's Ninth New Collegiate Dictionary* (1985); it is contemplated that both processes of adsorption and absorption occur in the molecular sieve structure of the invention.

If the honeycomb substrate comprises a molecular sieve structure, it, preferably, comprises zeolites supported on the honeycomb structure, with the zeolites selected from the group consisting of ZSM-5, USY, Mordenite, Beta zeolites and combinations of these. On the other hand, the molecular sieve structure may comprise an extruded zeolite selected from the same zeolite group.

Although one particular embodiment of this exhaust system is in a system where the honeycomb substrate is a molecular sieve or adsorber, it is contemplated that the honeycomb structure of the instant exhaust system could, simply be a catalyst structure. Preferably, a three-way catalyst, a light-off catalyst, an electrically heated catalyst, an oxidation catalyst or combinations thereof.

The present invention is hereinafter described in more detail by way of Examples, although the present invention should not in any way be restricted to these examples. In other words, the following non-limiting examples are presented to more fully illustrate the invention.

EXAMPLES

Examples 1–3

A simulated exhaust system like that system as depicted in FIG. 7 and utilizing the fluidics apparatus as illustrated in FIG. 4 was used to illustrate the increased efficiency of an exhaust system comprising the streamlined fluidics apparatus. Specifically, the honeycomb utilized in exhaust system was a 9 inch cylindrical 400 cell per square inch (cpsi) honeycomb structure exhibiting a 5.66 in. (14.37 cm) diameter and a 1.87 inch (4.75 cm) diameter central hole region. The fluidics apparatus utilized comprised of the following: (1) a conical exhaust flow converging device having a 3.25 in. (8.25 cm.) length and 4.375 in. (11.11 cm.) diameter inlet end positioned upstream and a 1.875 in. (4.76 cm.) outlet end positioned downstream; (2) a straight tube conduit positioned proximate to the honeycomb substrate's hole region, exhibiting a minimum outside diameter of 0.50 in. (1.59 cm.) and having an extension tapering to a maximum outside diameter of 0.75 in. (1.91 cm.) and exhibiting rounded downstream and outlet ends, both $R_3$ and $R_4$=0.0625 in., for delivering the diversion fluid—a configuration as depicted in FIG. 6; and (3) a bi-convex diverter body exhibiting a diameter of 1.0 in. (2.54 cm.) with a downstream surface exhibiting a curved outward shape of radius $R_1$=0.875 in (2.22 cm.) and an upstream surface exhibiting a curved inward shape radius $R_2$=0.422 in. (1.07 cm.) positioned approximately 0.5 mm (~0.2 in.) downstream the conduit outlet. In other words, a 0.5 mm slot was formed between the diverter body and the diverter conduit opening for passage of diversion fluid, air in this example.

Room temperature air, simulating exhaust flow, was passed into the housing and directed at the honeycomb substrate at volumetric flow rates of about 30, 40 and 50 cubic feet per minute (cfpm). The linear flow rate, in feet per minute (fpm), of the air leaving the honeycomb substrate was measured on the downstream face of the honeycomb structure utilizing a stationary Omegaflo model 610 Anemometer positioned horizontally across the diameter of the low-flow resistance flow region. Assuming a uniform flow throughout this region, these measurements were then used to calculate the average linear volume flow velocity of the entire central region area (Cent. Flow V.) and the calculated percent of flow in the center flow region; the calculations recorded in Table I.

An examination of Table I reveals that the exhaust flow utilizing the illustrated, more streamlined fluidics apparatus exhibits the desired increased flow efficiency or the ability to divert completely to one flow path or the other. For example, all the examples exhibit a nearly 100% simulated exhaust flow through the central hole for the diverter-off(N) condition, and the desired low or negative flow through the adsorber for the diverter-on condition (Y). Specifically, an undiverted simulated exhaust flow of 30 cfpm resulted in central hole region average linear flow velocity of about 1525 fpm; a central flow of approximately 95.6% On the other hand, the same 30 cfpm simulated exhaust flow resulted in a negative flow in the central hole region of about 300 fpm when operated during diversion conditions—approximately 8.5 cfpm of diverter air directed at the diverter.

TABLE I

| Ex. No. | Exhaust/ Diverter | Center Flow V. (fpm) | % flow through hole |
|---|---|---|---|
| 1 | 30 cfpm/N | 1525 | 95.6 |
| | 30 cfpm/Y | −300 | −14.8 |
| 2 | 40 cfpm/N | 2050 | 96.4 |
| | 40 cfpm/Y | 70 | 2.7 |
| 3 | 50 cfpm/N | 2610 | 98.1 |
| | 50 cfpm/Y | 360 | 11.6 |

Examples 4–6

A simulated exhaust system resembling the system as depicted in FIG. 1, utilizing a simple round flat-plate diverter body, was used to compare the flow characteristics of the previous systems with the inventive system. Specifically, these comparison exhaust systems were comprised of the following: (1) a 9.0 in (22.86 cm.) long, 5.6 in. (14.22 cm.) diameter, 400 cell per square inch (cpsi) cylindrical honeycomb structure possessing a 1.875 in. (4.76 cm.) diameter centrally located round first or low flow resistance region and, (2) a fluidics apparatus comprised of a 1.0 in. (2.54 cm.) diameter round diverter body positioned proximate to the honeycomb substrate's hole region approximately 0.039 in. (1 mm) downstream from the diversion fluid conduit (air supply tube) outlet. Air, simulating exhaust flow, was again directed at the honeycomb substrate at a volumetric flow rates of about 30,40 and 50 cubic feet per minute (cfpm) and diverter air of 8.5 cfpm was introduced through a non-tapered diversion fluid conduit possessing a straight non-rounded outlet. Flow measurements as above were obtained and recorded in Table II.

An examination of Table II and comparison to Examples 1–3 clearly shows that this comparison exhaust/fluidics system exhibits a far lesser ability to divert completely to one flow path or the other, i.e., a lesser flow efficiency. Specifically, the examples exhibit a simulated exhaust flow through the central hole for the diverter-off (N) condition of only between about 75–81%.

TABLE II

| Ex. No. | Exhaust/ Diverter | Center Flow V. (fpm) | % flow through hole |
|---|---|---|---|
| 4 | 30 cfpm/N | 1300 | 81.7 |
| | 30 cfpm/Y | −300 | −14.7 |
| 5 | 40 cfpm/N | 1700 | 80.3 |
| | 40 cfpm/Y | 80 | 3.1 |
| 6 | 50 cfpm/N | 2000 | 75.6 |
| | 50 cfpm/Y | 550 | 17.7 |

It should be noted that all flow data percentages reported in TABLES I–II are calculated flow percentages, which as previously described, are based on flow measurements taken across the horizontal diameter of the central or low flow resistance regions.

Examples 7–12

The same basic exhaust system, though slightly modified, described above for Examples 1–3, i.e. FIG. 8, was used to illustrate the increased flow uniformity exhibited by a converger device-containing "in-line" system utilizing tapered honeycomb substrates; the slight modification involved placing the fluidics diverted 0.24" (0.06 mm) downstream of the conduit outlet.

Three tapered exhaust system examples involved positioning a six inch long honeycomb, having an inlet face which exhibited a 30° taper, defined as θ on FIG. 8, and a 5.66 inch diameter, three varying distances downstream of the fluidics apparatus; reported as D in TABLE III. Each system was then subjected to a 30 cfpm simulated exhaust flow (room temperature air). Three flat-faced exhaust system examples involved utilizing a flat inlet-faced honeycomb structure of the same dimensions, positioned at the identical-varying distances, D, from the fluidics apparatus and thereafter subjecting them to the same simulated exhaust flow.

As before, the linear flow rate, in feet per minute (fpm), of the air leaving the honeycomb structure was measured on the downstream face of the honeycomb structures utilizing a stationary Omegaflo model 610 Anemometer. Flow measurements were taken for every other cell along a line ranging from the top to the bottom of each systems' honeycomb structure. These measurements, in feet per minute (fpm), were then used to calculate the average linear volume flow velocity of the honeycomb (Avg. Flow); these calculations, along with the highest and lowest measured flow for each system (Max. flow and Min. flow, respectively), are recorded in Table III.

Figure 11:
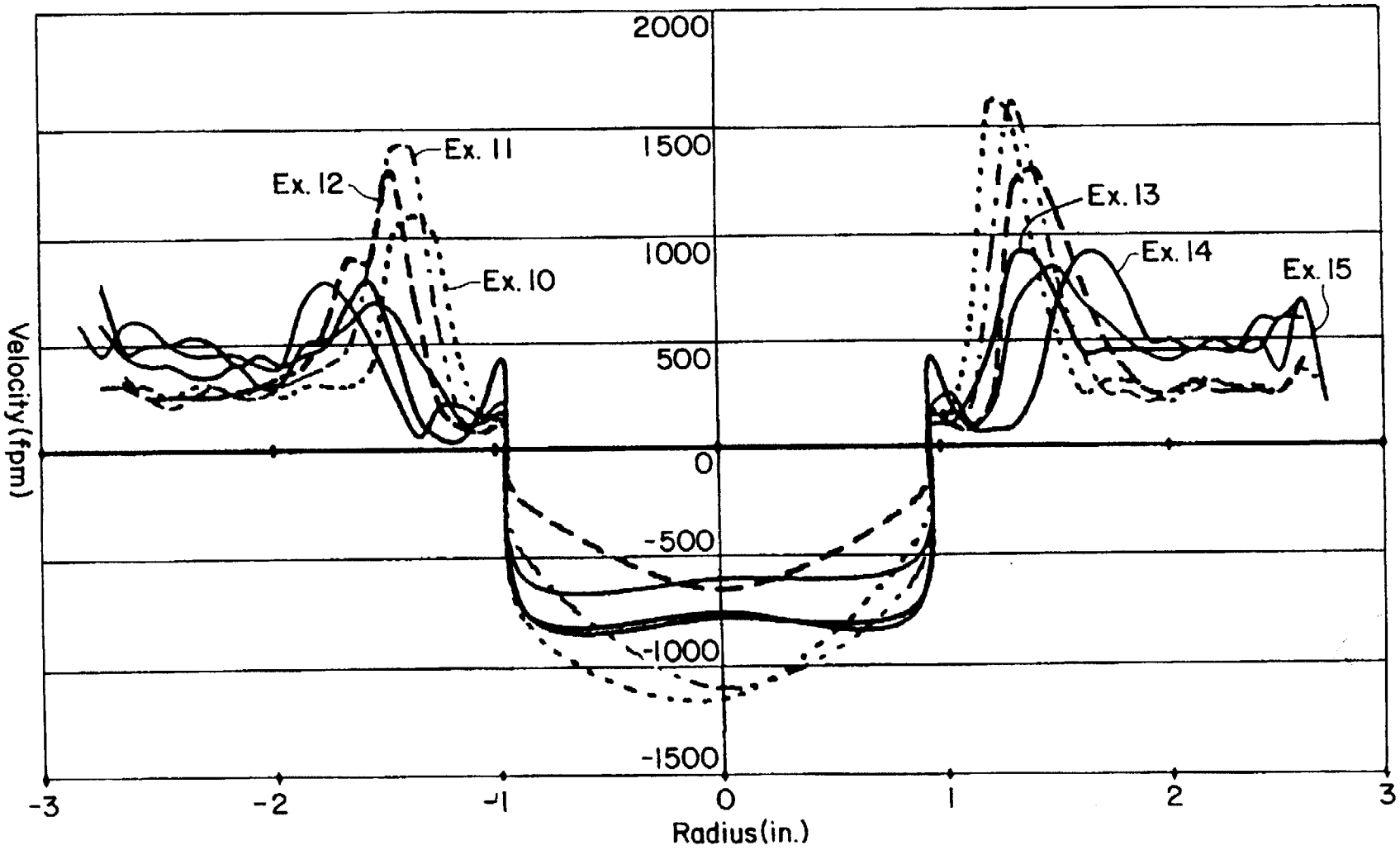
FIG. 11 is a graphical illustration comparing the flow distribution between flat and tapered inlet end honeycomb substrates.

An examination of TABLE III and FIG. 11, i.e., specifically comparing flat honeycomb-Examples 7–9 to tapered-honeycomb Examples 10–12 clearly reveals that tapered honeycomb exhaust systems exhibit a more uniform velocity distribution and lower peak exhaust flow values located in a more peripheral portion of the honeycomb. The exhaust systems which include the tapered honeycomb structures, Examples 10–12, exhibited a more peripherally located and reduced peak velocity, 850–900 fpm, when compared to those flat honeycomb structure-containing exhaust systems, Examples 10–12 which have more centrally located peak velocities ranging from 1300 to 1600 fpm.

TABLE III

| Ex. No. | 7 | 8 | 9 | 10 | 11 | 12 |
|---|---|---|---|---|---|---|
| D | 0.57 | 0.67 | 0.77 | 0.57 | 0.67 | 0.77 |
| Avg. Flow (fpm) | 434 | 451 | 428 | 467 | 436 | 446 |
| Max. flow (fpm) | 1600 | 1600 | 1300 | 900 | 900 | 850 |
| Min. flow (fpm) | 100 | 80 | 80 | 50 | 75 | 60 |

It will be appreciated from the foregoing description that the present invention has utility in a variety of systems for treating gas or other fluid streams, including any system wherein the handling of gas flows without the use of mechanical valves or other mechanical means of flow control is required. However, the systems of most immediate interest for such use are those involving the treatment of exhaust emissions from engines or other combustion exhaust gas sources. Accordingly, the preceding detailed description of the invention focused principally on such emissions control applications even though the use of the invention is not limited thereto.

Although the invention has been described with respect to the above illustrated description and examples, it may be subjected to various modifications and changes without departing from the scope of the invention. For example, although the examples have utilized only square cell channels, the invention can be extended to a variety of cell shapes for the honeycomb, (triangular, hexagonal, rectangular, flexible cells etc.). Furthermore, it is contemplated that although the above description describes the exhaust system as comprised of circular honeycombs it is appreciated that by suitably contouring the maximum diameter of the diverter body, the diversion fluid can be spread unevenly to direct exhaust gas through honeycombs of non circular cross-section, such as elliptical substrates.

We claim:

1. An engine exhaust system comprising:

a honeycomb structure having an inlet and outlet end disposed in a housing and located in an exhaust gas stream downstream from an engine, the honeycomb structure having a first substantially unobstructed flow region, and a second more obstructed flow region adjacent the first region, the first region being disposed to provide a substantially unobstructed flow path for the exhaust gases in the exhaust gas stream; and, a fluidics apparatus disposed in the exhaust stream comprising a bi-convex diverter body having two distinct surfaces located upstream and downstream of each other, the diverter body located proximate to the first region, a diversion fluid source and a tapered conduit possessing a rounded outlet for directing the diversion fluid toward the diverter body.

2. The exhaust system of claim 1 wherein the fluidics apparatus further includes an exhaust gas converger means disposed upstream of the diverter body for directing the flow of the exhaust towards the first flow region.

3. The exhaust system of claim 2 wherein the exhaust gas converger means is a conical shaped body disposed in the exhaust stream whereby the smaller opening of the conical body is located downstream of larger opening.

4. The exhaust system of claim 1 wherein the bi-convex diverter body downstream surface is curved outward with respect to a plane which is transverse to the direction of the exhaust gas stream and the upstream surface is curved inward with respect to a plane which is transverse to the direction of the exhaust gas stream.

5. The exhaust system of claim 1 wherein the bi-convex diverter body downstream surface and the upstream surface are curved outward with respect to a plane which is transverse to the direction of the exhaust gas stream.

6. The exhaust system of claim 1 wherein the bi-convex diverter body downstream surface and the upstream surface are curved inward with respect to a plane which is transverse to the direction of the exhaust gas stream.

7. The exhaust system of claim 1 wherein the bi-convex diverter body downstream surface is curved inward and the upstream surfaces is curved outward with respect to transverse to the direction of the exhaust gas stream.

8. The exhaust system of claim 1 wherein the conduit outlet is positioned sufficiently close to the diverter body whereby the diverter body imparts a flow component to the diversion fluid which is transverse to flow direction in the first region.

9. The exhaust system of claim 1 wherein the fluidics apparatus is positioned whereby a negative flow zone is created within the first region in a direction opposite that of the exhaust gas flow.

10. The exhaust system of claim 2 wherein the honeycomb structure includes a convexly shaped inlet end to thereby achieve a substantially uniform flow of exhaust through the substrate inlet end.

11. The exhaust system of claim 10 wherein the convexly shaped inlet end exhibits a shape selected from group of circular, elliptical, conical and frusto-conical.

12. An engine exhaust system comprising:

a honeycomb structure having an inlet and outlet end disposed in a housing and located in an exhaust gas stream downstream from an engine, the honeycomb structure having a first substantially unobstructed flow region, and a second more obstructed flow region adjacent the first region, the first region being disposed to provide a substantially unobstructed flow path for the exhaust gases in the exhaust gas stream; and, a fluidics apparatus disposed in the exhaust stream comprising an exhaust gas converger means for directing the flow of the exhaust towards the first flow region, a diverter body located downstream of the exhaust gas converger means proximate to the first region, a diversion fluid source and a tapered conduit possessing a rounded outlet for directing the diversion fluid toward the diverter body.

13. The exhaust system of claim 12 wherein the exhaust gas converger means is a conical shaped body disposed in the exhaust stream whereby the smaller opening of the conical body is located downstream of larger opening.

14. The exhaust system of claim 12 wherein the diverter body comprises a bi-convex diverter body having two distinct surfaces located upstream and downstream of each other.

15. The exhaust system of claim 14 wherein the bi-convex diverter body downstream surface is curved outward with respect to a plane which is transverse to the direction of the exhaust gas stream and the upstream surface is curved inward with respect to a plane which is transverse to the direction of the exhaust gas stream.

16. The exhaust system of claim 14 wherein the bi-convex diverter body downstream surface and the upstream surface are curved outward with respect to a plane which is transverse to the direction of the exhaust gas stream.

17. The exhaust system of claim 14 wherein the bi-convex diverter body downstream surface and the upstream surface are curved inward with respect to a plane which is transverse to the direction of the exhaust gas stream.

18. The exhaust system of claim 14 wherein the bi-convex diverter body downstream surface is curved inward with respect to a plane which is transverse to the direction of the exhaust gas stream and the upstream surfaces is curved outward with respect to a plane which is transverse to the direction of the exhaust gas stream.

19. The exhaust system of claim 12 wherein the conduit outlet is positioned sufficiently close to the diverter body whereby the diverter body imparts a flow component to the diversion fluid which is transverse to flow direction in the first region.

20. The exhaust system of claim 12 wherein the fluidics apparatus is positioned whereby a negative flow zone is created within the first region in a direction opposite that of the exhaust gas flow.

21. The exhaust system of claim 12 wherein the honeycomb structure includes a convexly shaped inlet end to thereby achieve a substantially uniform flow of exhaust through the substrate inlet end.

22. The exhaust system of claim 12 wherein the convexly shaped inlet end exhibits a shape selected from group of circular, elliptical, conical and frusto-conical.

* * * * *